United States Patent [19]

Pickering

[11] 4,050,662

[45] Sept. 27, 1977

[54] BRACKET

[76] Inventor: David Harrison Pickering, Five Farthings, Friston near Eastbourne, Sussex, England

[21] Appl. No.: 663,737

[22] Filed: Mar. 4, 1976

[51] Int. Cl.[2] ..... A47F 5/00

[52] U.S. Cl. ..... 248/291; 248/309 A

[58] Field of Search ..... 248/291, 294, 299, 309, 248/289, 290; 42/1 Y; 70/14, 57, 58

[56] References Cited

U.S. PATENT DOCUMENTS

| | | | |
|---|---|---|---|
| 802,705 | 10/1905 | Parker | 248/294 |
| 2,650,056 | 8/1953 | Masoner | 248/289 |
| 2,742,726 | 4/1956 | Feller | 42/1 Y |
| 3,422,560 | 1/1969 | Foote et al. | 70/58 |
| 3,574,340 | 4/1971 | Busche | 248/299 |
| 3,624,945 | 12/1971 | Foote | 42/1 Y |

*Primary Examiner*—Robert A. Hafer

*Attorney, Agent, or Firm*—Emory L. Groff, Jr.

[57] ABSTRACT

A bracket for fixing to a vertical structure for supporting firearms for display the bracket being adjustable so that different types of firearms of different balance can be supported at the trigger guard in a desired angular position.

2 Claims, 6 Drawing Figures

BRACKET

BACKGROUND OF THE INVENTION

This invention concerns a bracket for securing to a wall or other upright or substantially upright surface and for carrying and supporting articles for display.

The bracket according to the invention is primarily for supporting small firearms or models thereof, such as revolvers and pistols for display and the invention has for its object to provide a bracket of simple construction which can be used to support firearms of different types in a desired angular position on a wall, board or the like, by correctly setting up the bracket in relation to the type of firearm to be supported.

SUMMARY OF THE INVENTION

According to the invention, the bracket comprises a back disc plate, means for securing same to a substantially vertical structure, a front disc plate, means for pivotally securing the front plate against the backplate at the centers of said plates and for locking said plates in adjusted relative rotational disposition, and two spaced apart forwardly projecting pegs from said front plate, said pegs located off-center of the rotational axis, and to receive therebetween a trigger guard of a firearm.

With the above arrangement the front plate can be turned relatively to the fixed back plate so that the two pegs or stubs are positioned to hold the firearm in desired position which in practice will generally but not essentially be with the barrel axis substantially horizontal. The holding is achieved by virtue of a wedging or holding action of the trigger guard coupled with the fact that the trigger guard is off set in relation to the centre of balance of the firearm, e.g. when supported the greater weight on one side of the pegs tends to turn the firearm but this is prevented by the wedging action. It will be understood that there are many types of firearms particularly pistols and revolvers with different forms of guards and differently located triggers and adjacent parts and the bracket according to the invention enables most types to be supported by the correct positioning of the pegs or stubs in relation to the turning axis so that the desired wedging action is obtained.

BRIEF DESCRIPTION OF THE DRAWINGS

An embodiment according to the invention will now be described with reference to the accompanying drawings, in which.

DESCRIPTION OF PREFERRED EMBODIMENTS

Figure 1:
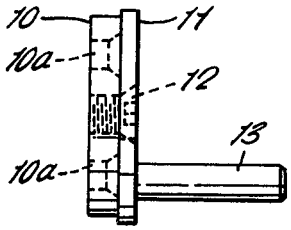
FIG. 1 is a side view of the bracket.
Figure 2:
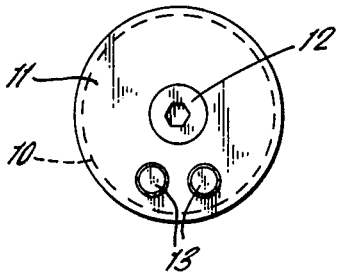
FIG. 2 a front view.
Figure 3:
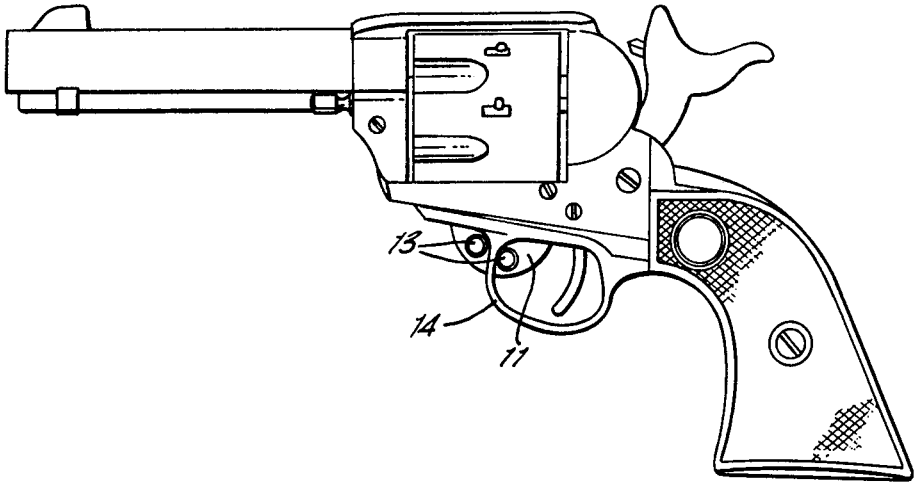
FIGS. 3 to 6 show the bracket supporting different types of firearms.
Figure 4:
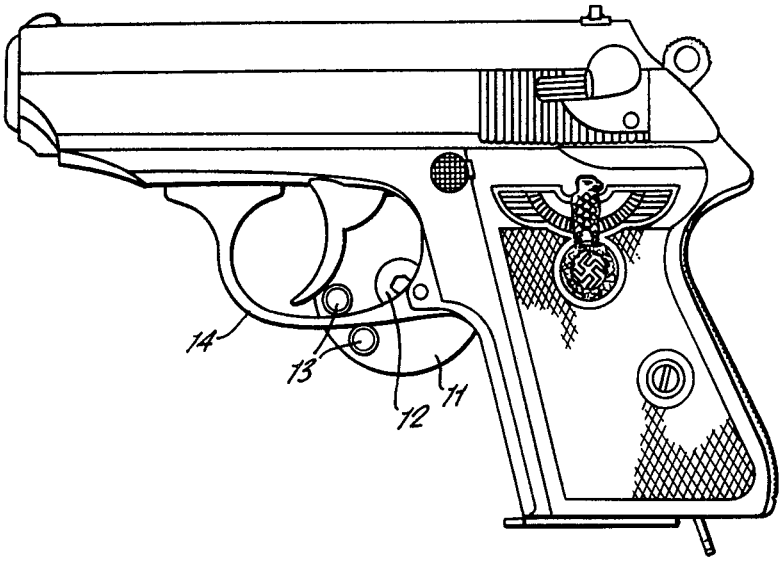
Figure 5:
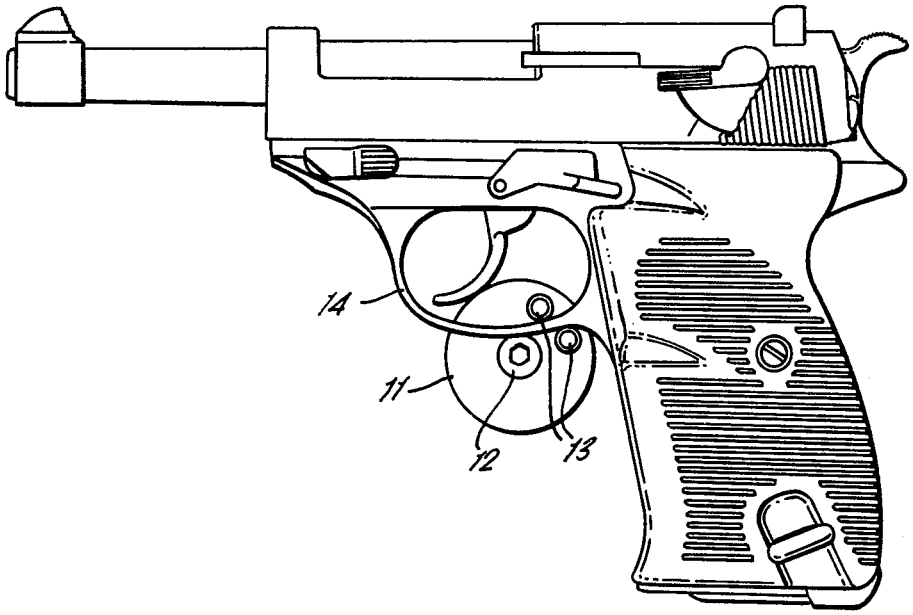
Figure 6:
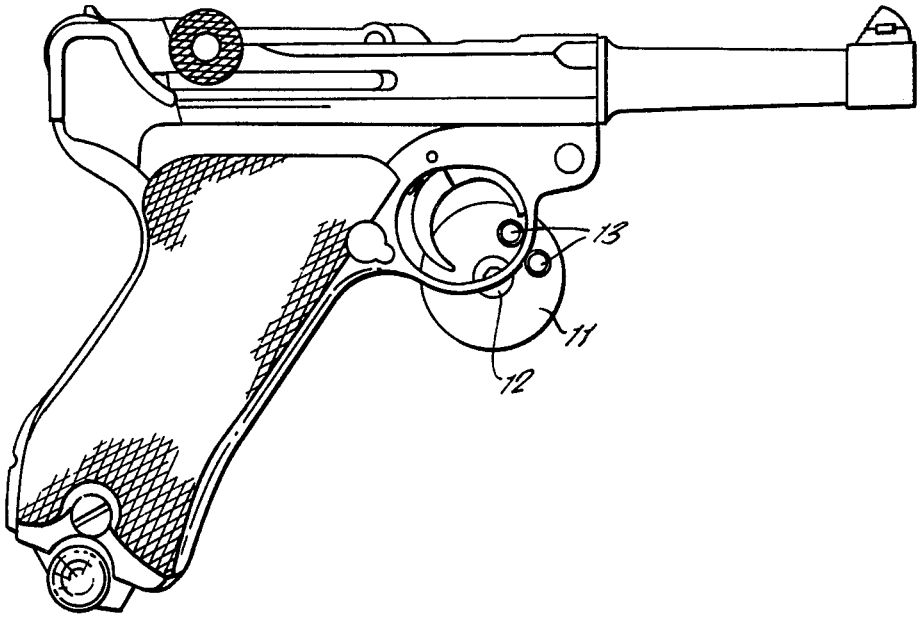

Referring to the drawings, the bracket comprises a disc back plate 10 and disc front plate 11. The back plate has counter sunk holes 10*a* whereby it can be secured to a wall display board or the like by means of screws.

The front plate 11 is mounted on the back plate by means of a bolt 12, the shank of which passes through an axial bore through the front plate and engages in a screw threaded axial bore in or through the back plate, whereby said front plate can be turned on the back plate, the front plate being freely rotatable on the bolt. The plates can then be locked up by tightening the bolt.

Two pegs or stubs 13, 13 extend forwardly from the front plate with axes parallel with the axis of the bolt 12. These pegs or stubs are close-spaced, at a distance to enable the trigger guard of a firearm to engage loosely therebetween.

FIGS. 3 to 6 show the bracket in use with different types of firearms, each having a trigger guard 14. In FIG. 1, the centre of balance of the firearm is such that it tends to tilt anti-clockwise i.e. barrel down, with the pegs in the position shown. In FIGS. 3 to 6, the firearm tends to tilt with the butt end down so that the firearm is held by a wedge action.

Although shown as supporting pistols and revolvers, the bracket of the invention can be used to support rifles, shot-guns and the like.

The bracket enables a number of firearms to be supported each by a bracket, and all at a desired angle, e.g. with barrel axes horizontal although the balance of each is different.

I claim:

1. A support bracket for displaying firearms, said bracket comprising a back disc plate, means for securing same to a substantially vertical structure, a front disc plate, means for pivotally securing the front plate against the backplate at the centers of said plates and for locking said plates in adjusted relative rotational disposition, and two spaced apart forwardly projecting pegs from said front plate, said pegs located off-center of the rotational axis and to receive therebetween a trigger guard of a firearm.

2. A support bracket as claimed in claim 1 wherein the back plate has holes therethrough and the securing means for said back plate comprise a fixing screw for each hole, and the pivotal securing means comprise a pivot bolt passing through the front plate and engaging in a screw threaded bore of the back plate.

* * * * *